US008328287B2

(12) United States Patent
Hsu

(10) Patent No.: US 8,328,287 B2
(45) Date of Patent: Dec. 11, 2012

(54) CHAIR STRUCTURE

(76) Inventor: Han-Chung Hsu, Taipei (TW)

( * ) Notice: Subject to any disclaimer, the term of this patent is extended or adjusted under 35 U.S.C. 154(b) by 14 days.

(21) Appl. No.: 13/028,315

(22) Filed: Feb. 16, 2011

(65) Prior Publication Data

US 2012/0112514 A1 May 10, 2012

Related U.S. Application Data

(63) Continuation-in-part of application No. 12/939,438, filed on Nov. 4, 2010.

(51) Int. Cl.
*A47C 7/02* (2006.01)

(52) U.S. Cl. ..... 297/452.1; 5/690; 5/936; 5/697

(58) Field of Classification Search ..... 5/690, 697, 5/716, 936, 727; 267/177, 170
See application file for complete search history.

(56) References Cited

U.S. PATENT DOCUMENTS

| | | | | | |
|---|---|---|---|---|---|
| 3,252,170 | A * | 5/1966 | Frye | ..... | 5/697 |
| 4,222,137 | A * | 9/1980 | Usami | ..... | 5/727 |
| 6,003,178 | A * | 12/1999 | Montoni | ..... | 5/690 |
| 6,487,738 | B1 * | 12/2002 | Graebe | ..... | 5/719 |
| 7,458,121 | B1 * | 12/2008 | Hsu | ..... | 5/716 |
| 7,934,277 | B1 * | 5/2011 | Shu | ..... | 5/690 |
| 2008/0276377 | A1 * | 11/2008 | Hsu | ..... | 5/727 |

* cited by examiner

*Primary Examiner* — Robert G Santos
*Assistant Examiner* — Brittany Wilson
(74) *Attorney, Agent, or Firm* — Ming Chow; Sinorica, LLC

(57) ABSTRACT

The chair structure comprises: a chair body, including a seat cushion and a back cushion; a fixing plate, being firmly disposed in the chair body and having a plurality of fixing holes; a moving plate, being disposed above the fixing plate, the moving plate having a plurality of penetrating holes; a plurality of flexible members, being disposed on the surface of the top end of the moving plate; a plurality of fixing members, each of the fixing members having a fastening end and a connecting end; and a plurality of lifting devices, being disposed at the bottom of the moving plate, by means of the lifting devices driving the moving plate and the fixing members holding the flexible members, the flexible members being then compressed in order to adjust the flexible supporting forces of the chair body.

9 Claims, 8 Drawing Sheets

CHAIR STRUCTURE

CROSS REFERENCE TO RELATED APPLICATION

This application is a Continuation-in-part of Ser. No. 12/939,438, filed Nov. 4, 2010, all of which is incorporated herein by reference.

BACKGROUND OF THE INVENTION

1. Field of the Invention

The present invention generally relates to a chair structure, more particularly to a chair structure that is able to adjust the flexible supporting forces thereof so as to let that different users can be provided with different levels of softness.

2. Description of the Prior Art

In generally, a chair structure is composed of a wooden structure covering with seat cushion and back cushion. The seat cushion and back cushion comprised springs or sponge pads in it. And they are wrapped up by fabric or leather, as well as the hand-rest.

Chair structure generally has fixed elasticity and shape, the softness of the seat cushion or back cushion was decided when it was made. Users cannot adjust the chair according to personal desires when they are using it. Users will feel uncomfortable if the cushions are not made by following the ergonomics.

Thereby, to develop a new type of chair structure is an issue for the skilled persons in the art and may be discussed hereinafter.

SUMMARY OF THE INVENTION

The main objective of the present invention is to provide a chair structure, which applies the movement of a moving plate and the connections and fixes of fixing members and flexible members in order to adjust the flexible supporting forces of the chair structure. Thus different users can be provided with different levels of softness.

To achieve the objective, the present invention provides the chair structure comprises: a chair body, including a seat cushion and a back cushion; a fixing plate, being firmly disposed in the seat cushion and back cushion of the chair body and having a plurality of fixing holes; a moving plate, being disposed in the chair body and above the fixing plate, the moving plate having a plurality of penetrating holes; a plurality of flexible members, being disposed on the surface of the top end of the moving plate, the bottom ends of the flexible members being corresponding to the penetrating holes; a plurality of fixing members, each of the fixing members having a fastening end and a connecting end, the fastening end going through the penetrating hole and associating with the fixing hole of the fixing plate, the connecting end joining with the top end of the flexible member; and a plurality of lifting devices, being disposed at the bottom of the moving plate, by means of the lifting devices driving the moving plate and the fixing members holding the flexible members, the flexible members being then compressed in order to adjust the flexible supporting forces of the chair body.

Preferably, the lifting device comprises a plurality of motors and a plurality of power transmission shafts which is disposed on the motor and connected the moving plate correspondingly.

Preferably, the fastening end of the fixing member is shaped as a ladder-type structure so as to let the fixing member be fixed in the fixing plate while the fastening end is inserted into the fixing hole; the connecting end is shaped as an L-type structure in order to hook the top end of the flexible member for connecting the fixing member and the flexible member.

Preferably, the lifting devices are disposed at the four corners of the moving plate.

Preferably, the lifting devices are disposed at the center of the moving plate.

Preferably, the power transmission shaft is a screw rod.

Preferably, the top layer of the flexible member is a flexible layer.

Preferably, the lifting device is connected with a remote receiver and a remote emitter, an operator uses the remote receiver to control the up and down actions of the lifting device by means of the remote emitter transmitting signals to the remote receiver.

Preferably, the lifting device comprises an air compressor which is disposed under the fixing plate; a plurality of air bags which are disposed between the moving plate and the fixing plate, the air bags are connected with the air compressor through a plurality of tubes, the air bags are inflated by the air compressor.

Preferably, a plurality of positioning pillars are disposed on the fixing plate, the positioning pillars are penetrated through the moving plate so as to let the moving plate steadily move up and down.

Preferably, a height sensor is disposed between the moving plate and the fixing plate and connected with the air compressor or the motor, the distance data between the moving plate and the fixing plate is transmitted to the air compressor or the motor so as to control the displacement of the moving plate.

Other and further features, advantages, and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Figure 1:
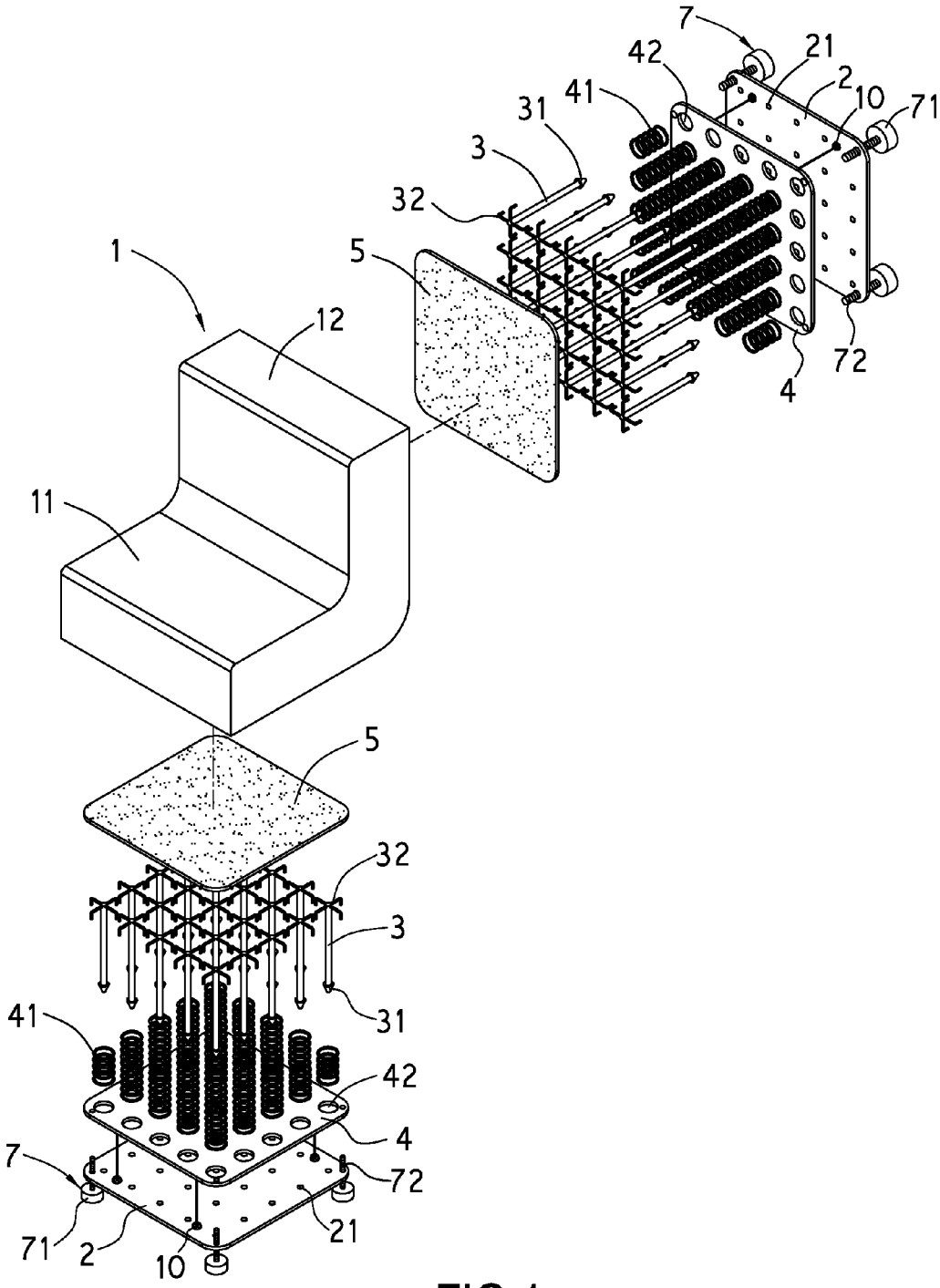
FIG. 1 illustrates a schematic 3-D exploded view of the chair structure of the present invention.
Figure 2:
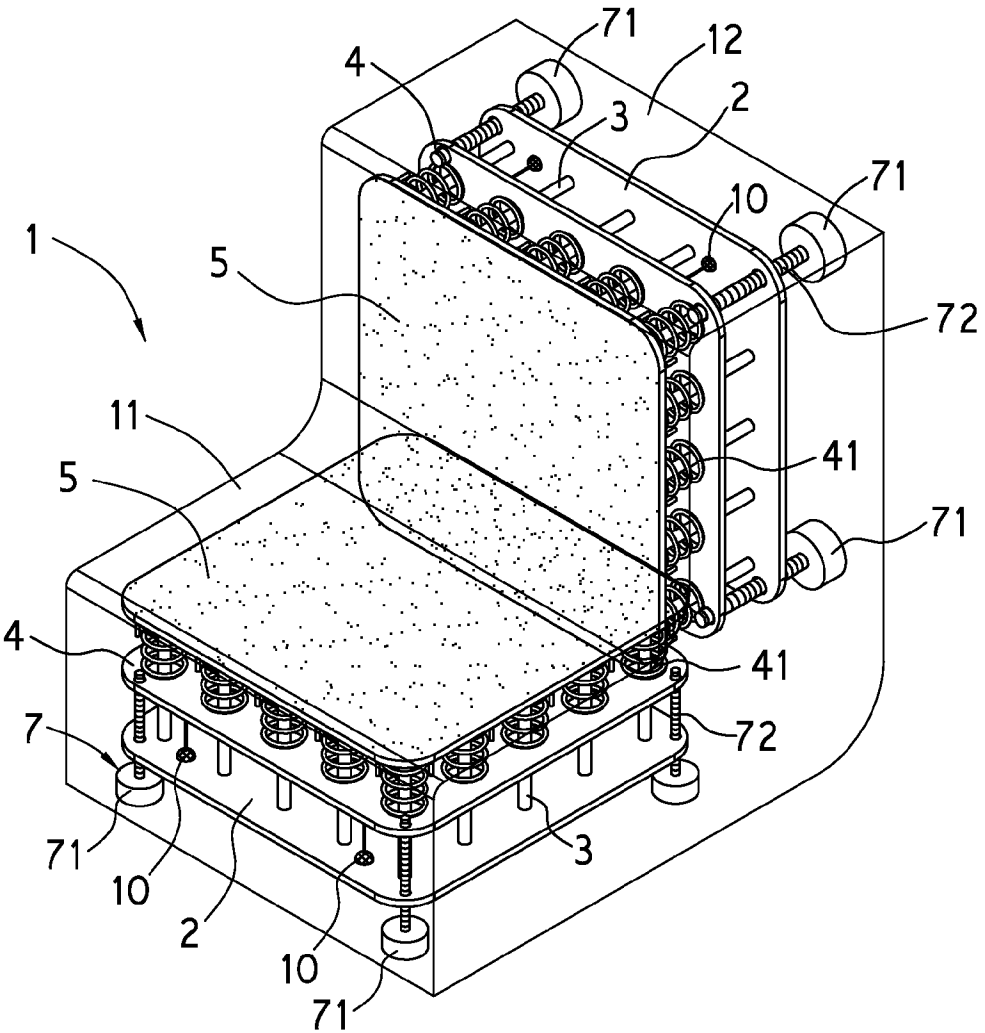
FIG. 2 illustrates a schematic 3-D assembled view of the chair structure of the present invention.
Figure 3:
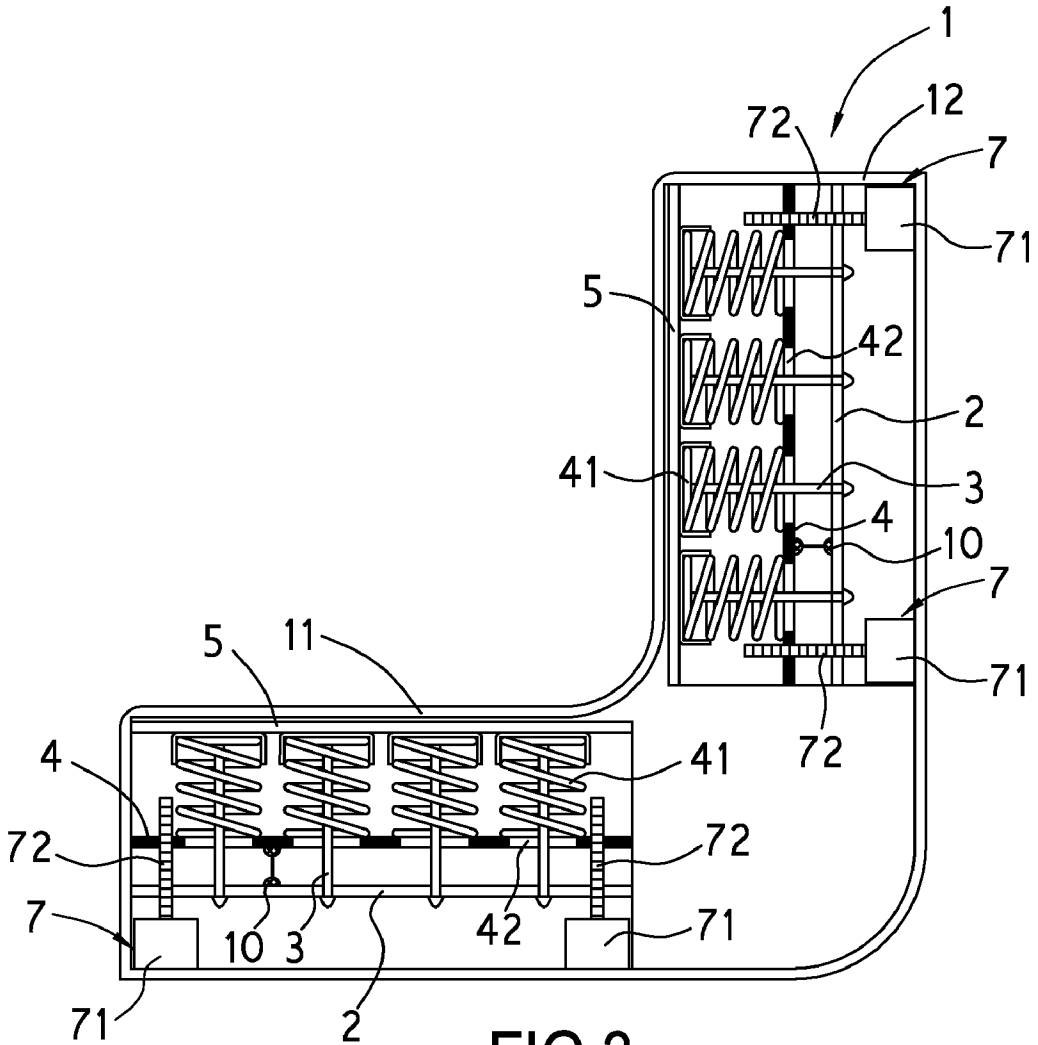
FIG. 3 illustrates a schematic lateral view of the chair structure of the present invention.
Figure 4:
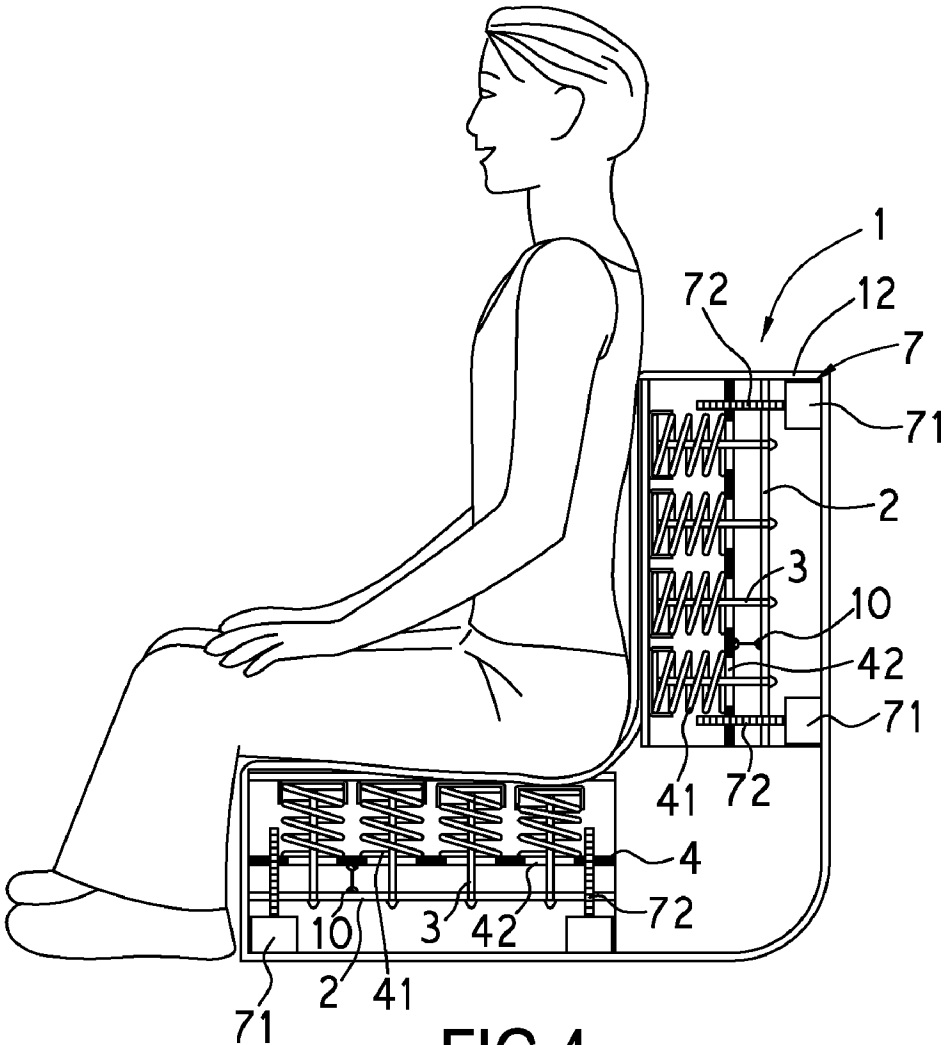
FIG. 4 illustrates a schematic application lateral view of the chair structure of the present invention.

Following preferred embodiments and figures will be described in detail so as to achieve aforesaid objects.

With references to FIG. 1 to FIG. 4, which illustrate a schematic 3-D exploded view of the chair structure of the present invention, a schematic 3-D assembled view of the chair structure of the present invention, a schematic lateral view of the chair structure of the present invention, and a schematic application lateral view of the chair structure of the present invention. The chair structure includes:

a chair body 1, which includes a seat cushion 11 and back cushion 12;

a fixing plate 2, which is firmly disposed in the chair body 1 and has a plurality of fixing holes 21, the fixing plate 2 can be a fixing base or a fixing frame;

a moving plate 4, which is disposed in the chair body 1 and above the fixing plate 2, a plurality of flexible members 41 are disposed on the surface of the top end of the moving plate 4, bottom ends of the flexible members 41 of the moving plate 4 have a plurality of penetrating holes 42, the bottom ends of the flexible members 41 are corresponding to the penetrating holes 42;

a plurality of fixing members 3, each of the fixing members 3 has a fastening end 31 and a connecting end 32, the fastening end 31 goes through the penetrating hole 42 and the connecting end 32 shaped as an L-type or n-shaped structure hooks the top end of the flexible member 41, and the fastening end 31 associates with the fixing hole 21 of the fixing plate 2, the fastening end 31 of the fixing member 3 is shaped as a ladder-type structure so as to let the fixing member 3 be fixed in the fixing plate 2 while the fastening end 31 is inserted into the fixing hole 21, further that, the connecting end 32 and the fixing member 3 are integrally made and shaped as an L-type structure;

a flexible layer 5, which is disposed on the top layer of the flexible member 41;

a plurality of lifting devices 7, which is disposed at the bottom of the moving plate 4 or the bottom of the fixing plate 2, for the embodiment, the lifting devices 7 are disposed at the four corners of the moving plate 4 or the four corners of the fixing plate 2, such two locations may not be limited to the scope, and the center of the moving plate 4 is another option, the lifting device 7 has a plurality of motors 71 and a plurality of power transmission shafts 72 connected with the moving plate 4, each of the power transmission shaft 72 is a screw rod, therefore the moving plate 4 is moved up and down through the motors 71 driving the power transmission shafts 72, the connecting end 32 of the fixing member 3 and the fixing member 3 are integrally made, one point to be noted is the connecting end 32 can be made by soft lines and connected with the flexible members 41, and a height sensor 10 is disposed between the moving plate 4 and the fixing plate 3, the height sensor 10 can transmit signal it received to the motor 71 so as to control displacement of the moving plate 4;

further, the lifting device 7 is not only a motor and can be an oil pressure expandable stick or air pressure expandable stick as well;

the lifting device 7 is connected with a remote receiver and a remote emitter (not shown in figure), the remote receiver is electrically connected with the motors 71 and receives the signals from the remote emitter in order to control the motors 71, the remote emitter is able to emit singles at least including activation, going up and lowering down to the remote receiver, hence an operator uses the remote receiver to control the up and down actions of the lifting device 7 by means of the remote emitter transmitting signals to the remote receiver.

While the fixing member 3 is a hard pillar, the fastening end 31 and the fixing hole 21 of the fixing plate 2 are fastened to each other, therefore the fixing member 3 goes down while the flexible member 41 presses downwardly.

More, the connecting end 32 of the fixing member 3 can be directly connected with the top end of the flexible member 41 as well.

Figure 5:
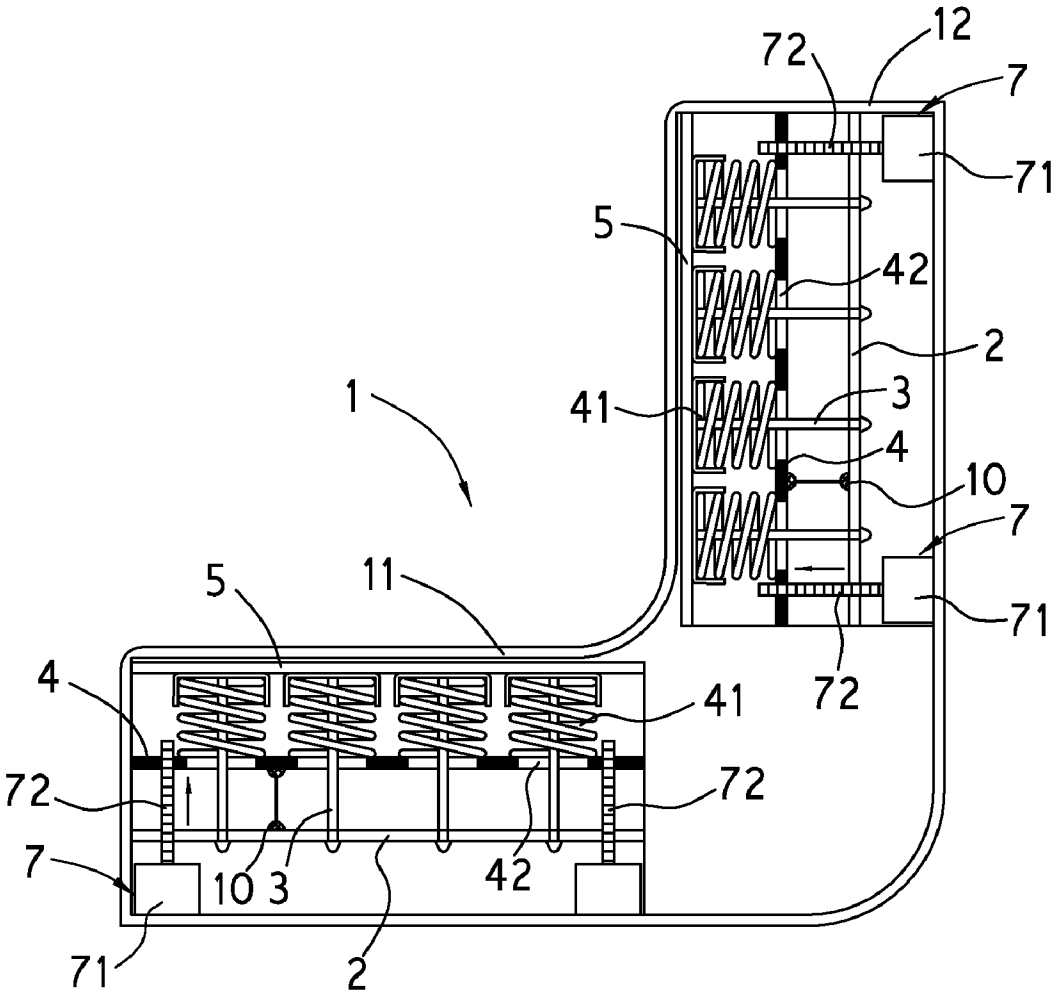
FIG. 5 illustrates a schematic application view of the moving plate of the chair structure of the present invention.

With reference to FIG. 5, which illustrates a schematic application view of the moving plate of the chairstructure of the present invention. While the user increases the flexible supporting forces of the chair structure, to start the motors 71 is to drive the power transmission shafts 72 to move the moving plate 4 upwardly. Meanwhile the flexible members 41 are compressed by the moving plate 4 due to the movement of the moving plate 4. Since each of the flexible members 41 is firmly connected with the fixing member 3, then one end of the flexible member 41 is fixed and the other end of the flexible member 41 is compressed. Apparently, the flexible member 41 appears a state of squeeze, and the flexible supporting force is increased. On the contrary, when the user wants to decrease the flexible supporting forces, through the motors 71 of the lifting devices 7 driving the moving plate 4 downwardly is to decrease the squeeze condition of the flexible members 41, so that the flexible supporting forces are decreased.

Figure 6:
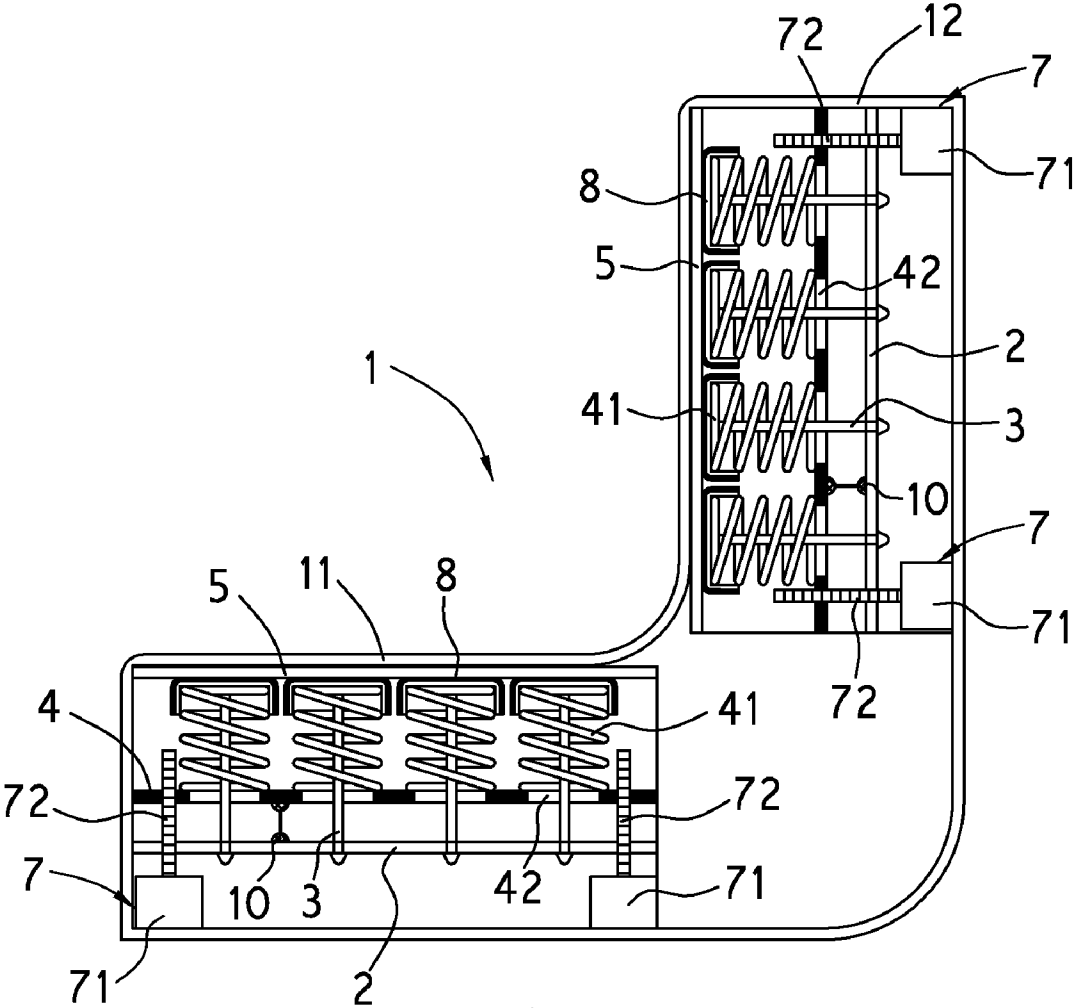
FIG. 6 illustrates another schematic application view of the moving plate of the chair structure of the present invention.

With reference to FIG. 6, which illustrates another schematic application view of the moving plate of the chair structure of the present invention. For the embodiment, a cover member 8 is disposed on the top ends of the flexible members 41, that is, the cover member 8 covers around the top ends of the flexible members 41. The cover member 8 may let the flexible members 41 averagely accept the forces while the flexible members 41 are compressed/uncompressed by the moving plate 4 due to the movement of the lifting devices 7 driving the moving plate 4. As a result, not only the life of each of the flexible members 41 is extended, but also the applied flexible supporting forces of the chair structure are more average.

Figure 7:
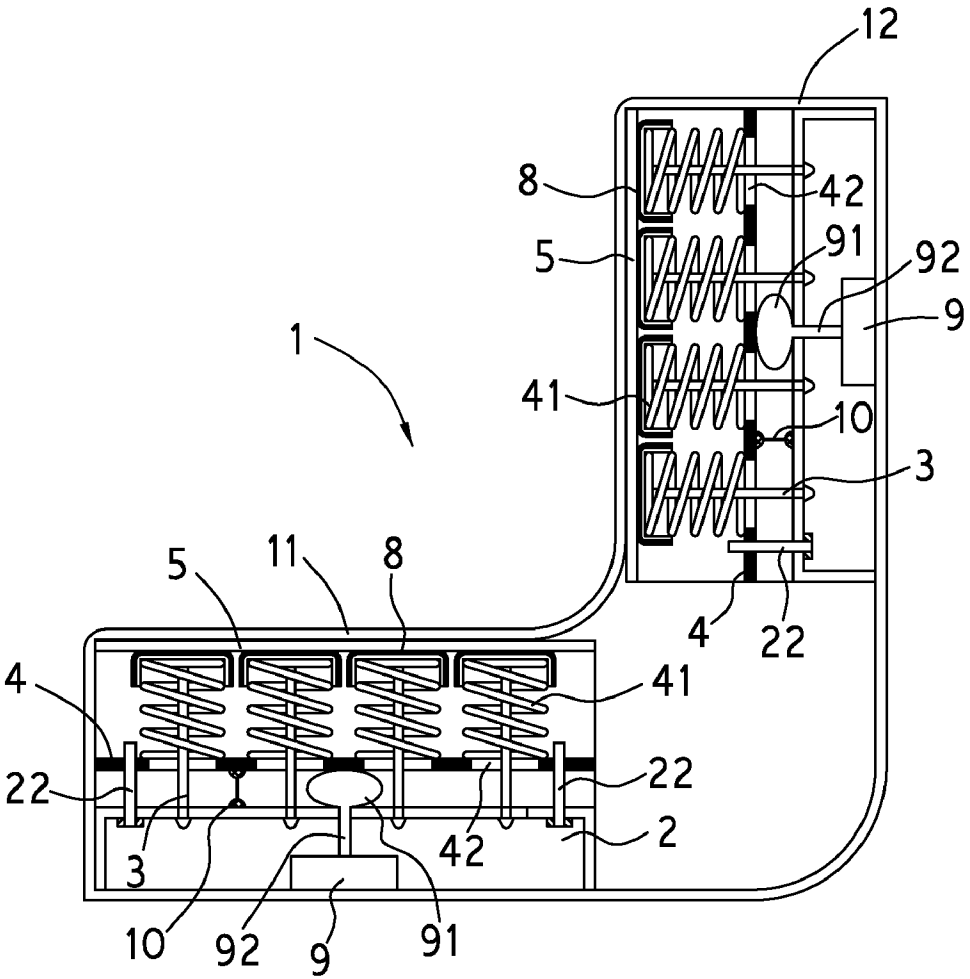
FIG. 7 illustrates a schematic sectional structural view of a preferred embodiment of a lifting device of the chair structure of the present invention.

With reference to FIG. 7, which illustrates a schematic sectional structural view of a preferred embodiment of the lifting device of the chair structure of the present invention. In the preferred embodiment, a lifting device 7 includes a air compressor 9, a plurality of air bags 91, and a plurality of tubes 92, the air compressor 9 is disposed under the fixing plate 2, the air bags 91 are between the moving plate 4 and the fixing plate 2, the air bags 91 are connected with the air compressor 9 through the tubes 92 in order to let the air bags 91 be inflated by the air compressor 9; a plurality of positioning pillars 22 are disposed on the fixing plate 2, the positioning pillars 22 are penetrated through the moving plate 4 so as to let the moving plate 4 steadily move up and down.

Besides, a height sensor 10 is disposed between the moving plate 4 and the fixing plate 2 and connected with the air compressor 9, the distance data between the moving plate 4 and the fixing plate 2 is transmitted to the air compressor 9 so as to control the displacement of the moving plate 4.

While the user demands that the support forces of the chair body 1 are promoted, the air compressor 9 inflates the air bags 91 and the moving plate 4 moves up. Meanwhile the flexible members 41 are compressed by the moving plate 4 due to the movement of the moving plate 4. Since each of the flexible members 41 is firmly connected with the fixing member 3, then one end of the flexible member 41 is fixed and the other end of the flexible member 41 is compressed. Apparently, the flexible member 41 appears a state of squeeze, and the flexible supporting force is increased. On the contrary, when the user wants to decrease the flexible supporting forces, to leak the air in the air bags 91 through the air compressors 93 is to lower down the moving plate 4. That is, the support forces are decreased.

Figure 8:
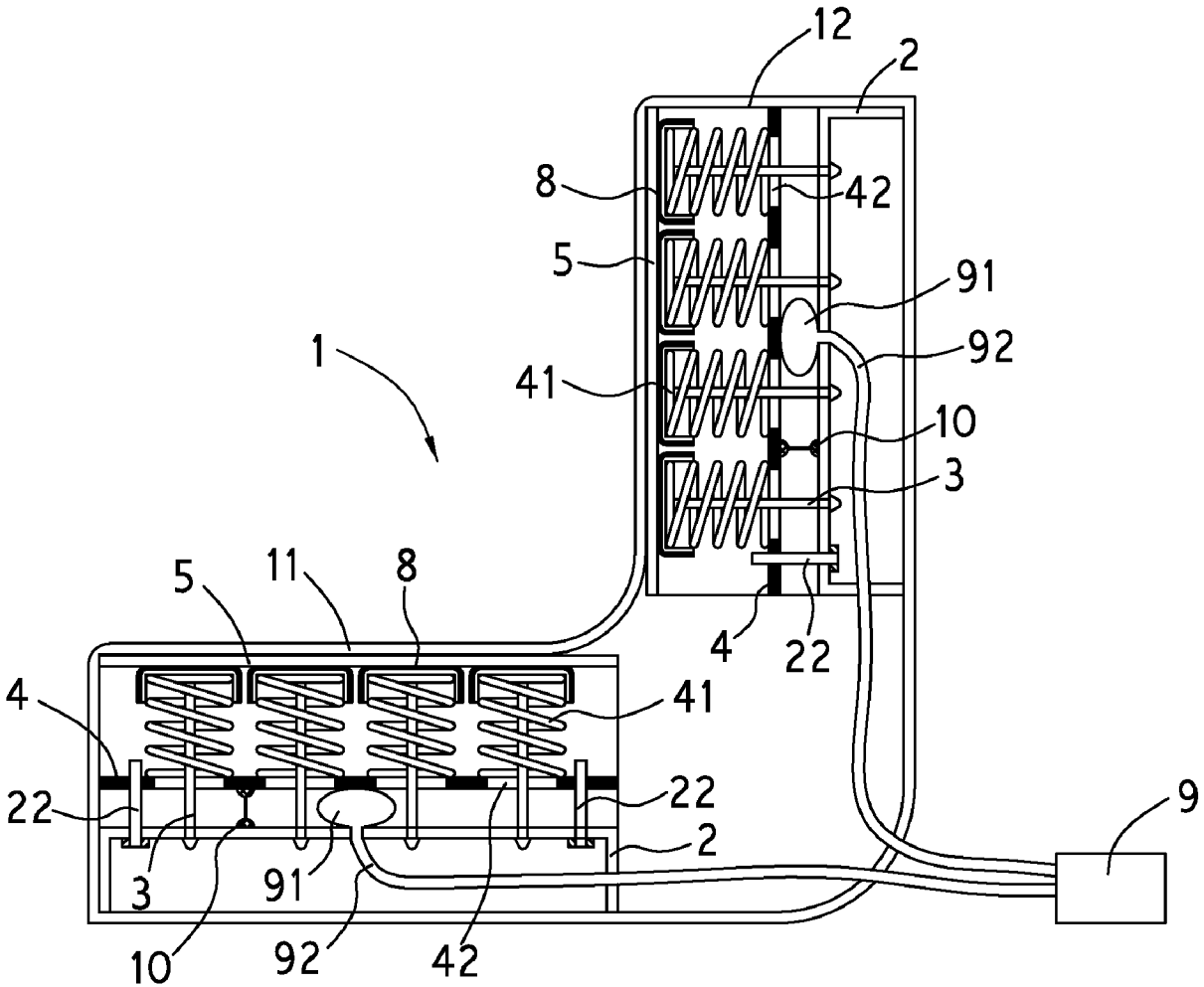
FIG. 8 illustrates a schematic sectional structural view of another preferred embodiment of the lifting device of the chair structure of the present invention.

With reference to FIG. 8, which illustrates a schematic sectional structural view of another preferred embodiment of the lifting device of the chair structure of the present invention. The preferred embodiment is the mostly like the preferred embodiment in FIG. 7 in the aspect of structure, and it may not be described any further hereinafter. The difference is to dispose the air compressor 9 outside the chair, and the air compressor 9 is connected with the air bags 91 after the air bags 91 are connected with each other through the tubes 92. By means of the outside air compressor 9, the height of the chair is lowered down for decreasing an occupied volume.

Compared with prior art, the chair structure provided by the present invention further offers the following advantages:

The chair structure, by means of the displacement of the moving plate and the fixing member associated to the flexible member, is able to adjust the flexible supporting forces thereof so as to let that different users can be provided with different levels of softness.

What is claimed is:

1. A chair structure comprising:

a chair body;

a fixing plate, being firmly disposed in the chair body and having a plurality of fixing holes;

a moving plate, being disposed in the chair body and above the fixing plate, the moving plate having a plurality of penetrating holes;

a plurality of flexible members, being disposed on the surface of the top end of the moving plate, the bottom ends of the flexible members being corresponding to the penetrating holes;

a plurality of fixing members, each of the fixing members having a fastening end and a connecting end, the fastening end going through the penetrating hole and associating with the fixing hole of the fixing plate, the connecting end joining with the top end of the flexible member; and a plurality of lifting devices, being disposed at the bottom of the moving plate, by means of the lifting devices driving the moving plate and the fixing members holding the flexible members, the flexible members being then compressed in order to adjust the flexible supporting forces of the chair body, wherein the lifting devices comprising a air compressor, a plurality of air bags, and a plurality of tubes, the air compressor is disposed under the fixing plate, the air bags are between the moving plate and the fixing plate, the air bags are connected with the air compressor through the tubes in order to let the air bags be inflated by the air compressor.

2. The chair structure according to claim 1, wherein the lifting device is connected with a remote receiver and a remote emitter, by using the remote receiver to control the up and down actions of the lifting device by means of the remote emitter transmitting signals to the remote receiver.

3. The chair structure according to claim 1, wherein the lifting device has a plurality of motors and a plurality of power transmission shafts connected with the moving plate.

4. The chair structure according to claim 1, wherein the fastening end of the fixing member is shaped as a ladder-type structure so as to let the fixing member be fixed in the fixing plate while the fastening end is inserted into the fixing hole, the connecting end is shaped as an L-type structure in order to hook the top end of the flexible member for connecting the fixing member and the flexible member.

5. The chair structure according to claim 1, wherein the top layer of the flexible member is a flexible layer.

6. The chair structure according to claim 1, wherein a plurality of positioning pillars are disposed on the fixing plate, the positioning pillars being penetrated through the moving plate so as to let the moving plate steadily move up and down.

7. The chair structure according to claim 1, wherein a height sensor is disposed between the moving plate and the fixing plate and connected with the air compressor, the distance data between the moving plate and the fixing plate is transmitted to the air compressor so as to control the displacement of the moving plate.

8. The chair structure according to claim 1, wherein the fastening end of the fixing member is shaped as a ladder-type structure so as to let the fixing member 3 be fixed in the fixing plate while the fastening end is inserted into the fixing hole, the connecting end is shaped as an L-type structure in order to hook the top end of the flexible member for connecting the fixing member and the flexible member.

9. The chair structure according to claim 1, wherein the top layer of the flexible member is a flexible layer.

* * * * *